US005552659A

United States Patent [19]

Macaulay et al.

[11] Patent Number: 5,552,659

[45] Date of Patent: Sep. 3, 1996

[54] STRUCTURE AND FABRICATION OF GATED ELECTRON-EMITTING DEVICE HAVING ELECTRON OPTICS TO REDUCE ELECTRON-BEAM DIVERGENCE

[75] Inventors: John M. Macaulay, Palo Alto; Christopher J. Spindt, Menlo Park; Patrick A. Corcoran, Oakland; Lee H. Veneklasen, Castro Valley, all of Calif.

[73] Assignee: Silicon Video Corporation, San Jose, Calif.

[21] Appl. No.: 269,312

[22] Filed: Jun. 29, 1994

[51] Int. Cl.[6] ..... H01J 1/02

[52] U.S. Cl. ..... 313/310; 313/309; 313/336; 313/351

[58] Field of Search ..... 313/309, 310, 313/336, 351, 422, 506

[56] References Cited

U.S. PATENT DOCUMENTS

| | | | |
|---|---|---|---|
| 4,008,412 | 2/1977 | Yuito et al. | 313/309 |
| 4,338,164 | 7/1982 | Spohr . | |
| 4,345,181 | 8/1982 | Shelton | 313/309 |
| 5,019,003 | 5/1991 | Chason | 313/309 |
| 5,070,282 | 12/1991 | Epsztein | 313/336 |
| 5,129,850 | 7/1992 | Kane et al. | 313/309 |
| 5,141,460 | 8/1992 | Jaskie et al. | 313/309 |
| 5,150,019 | 9/1992 | Thomas et al. | 313/309 |
| 5,151,061 | 9/1992 | Sandhu | 313/309 |
| 5,199,918 | 4/1993 | Kumar | 445/50 |
| 5,229,331 | 7/1993 | Doan et al. | 313/309 |
| 5,252,833 | 10/1993 | Kane et al. | 250/423 |
| 5,278,475 | 1/1994 | Jaskie et al. | 313/308 |

OTHER PUBLICATIONS

Busta, "Vacuum microelectronics—" 1992, *J. Micromech. Microeng.*, 1992, pp. 43–74.

Fischer, "Production and use of nuclear tracks; imprinting structure on solids," *Reviews of Modern Phys.*, Oct. 1993, pp. 907–948.

*Primary Examiner*—Sandra L. O'Shea
*Assistant Examiner*—Vip Patel
*Attorney, Agent, or Firm*—Skjerven, Morrill, MacPherson, Franklin & Friel; Alan H. MacPherson; Ronald J. Meetin

[57] ABSTRACT

An electron emitter contains a gate layer (38), an underlying dielectric layer (36), an intermediate non-insulating layer (34) situated below the dielectric layer, and a lower non-insulating region (32) situated below the intermediate non-insulating layer. A multiplicity of electron-emissive particles (42) are situated over the non-insulating region at the bottom of an opening (40) extending through the three layers. The ratio of the thickness of the dielectric layer to the thickness of the intermediate non-insulating layer is in the range of 1:1 to 4:1, while the ratio of the mean diameter of the opening to the thickness of the intermediate non-insulating layer is in the range 1:1 to 10:1. The presence of the intermediate non-insulating layer improves the collimation of the beam of electrons emitted from the electron-emissive elements. The electron emitter is manufactured according to a simple, readily controllable process.

26 Claims, 5 Drawing Sheets

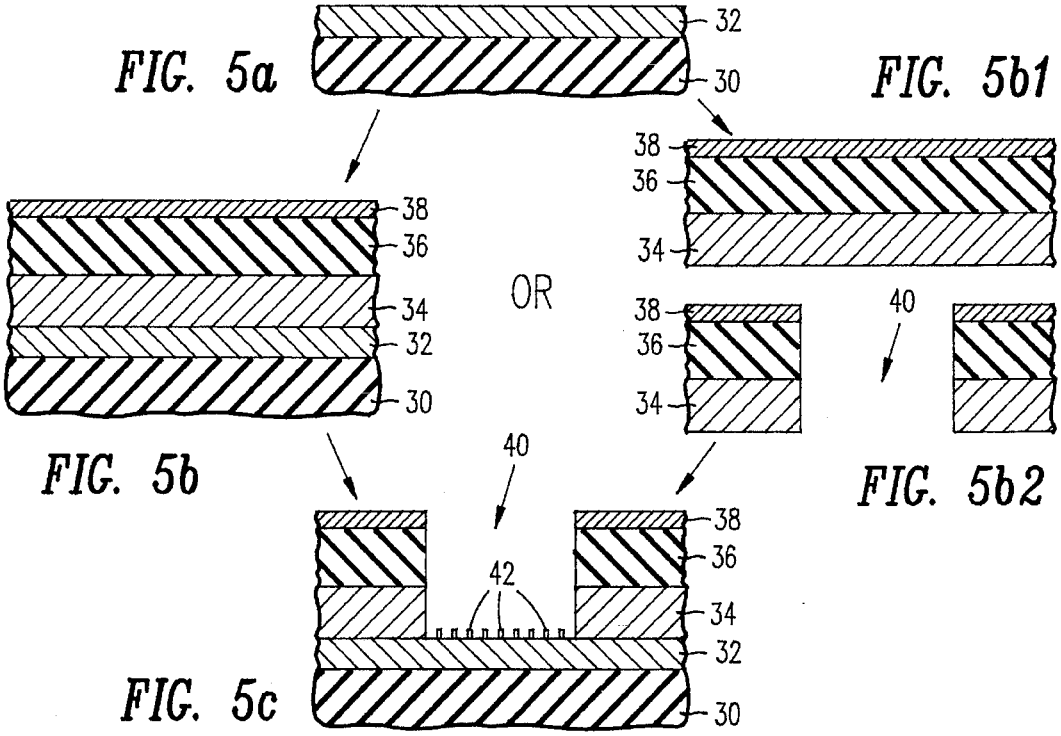
FIG. 5a
32
30
FIG. 5b1
38
36
34
OR
38
36
34
32
30
FIG. 5b
38
36
34
40
FIG. 5b2
40
38
36
42
34
32
30
FIG. 5c
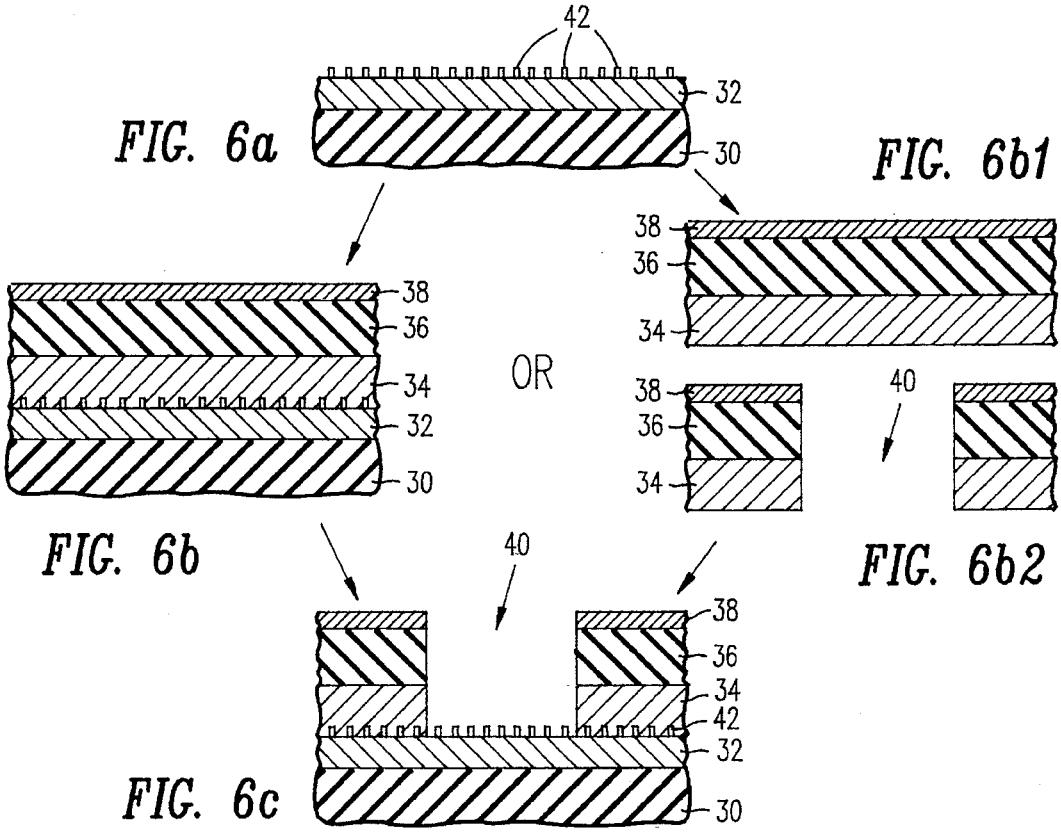
42
32
30
FIG. 6a
FIG. 6b1
38
36
34
OR
38
36
34
32
30
FIG. 6b
38
36
34
40
FIG. 6b2
40
38
36
34
42
32
30
FIG. 6c

STRUCTURE AND FABRICATION OF GATED ELECTRON-EMITTING DEVICE HAVING ELECTRON OPTICS TO REDUCE ELECTRON-BEAM DIVERGENCE

FIELD OF USE

This invention relates to electron-emitting devices. More particularly, this invention relates to structures and manufacturing techniques for electron-emitting devices, commonly referred to as cathodes, suitable for products such as cathode-ray tube ("CRT") displays of the flat-panel type.

BACKGROUND ART

Cathodes can emit electrons by photoemission, thermionic emission, and field emission, or as the result of negative electron affinity. A field-emission cathode (or field emitter) emits electrons when subjected to an electric field of sufficient strength. The electric field is created by applying a suitable voltage between the cathode and an electrode, typically referred to as the anode or gate electrode, situated a short distance away from the cathode.

Chason, U.S. Pat. 5,019,003, discloses a flat-panel display that utilizes a field emitter in which a group of electron-emissive particles are distributed across the top of a substrate. A three-layer sandwich consisting of a lower dielectric layer, an electrically conductive gate electrode layer, and an upper dielectric layer is situated over the substrate and electron-emissive particles. Openings extend through the three layers down to the substrate to expose a group of the electron-emissive particles within each opening. The electron-emissive particles serve as cathode elements.

A viewing-screen structure overlies the field emitter. The screen structure consists of a transparent screen, a patterned anode lying along the bottom of the screen, and luminescent material situated along the bottom of the anode directly above the top of the field emitter. The pattern of the anode corresponds to picture elements ("pixels") of the display.

Jaskie et al, U.S. Pat. 5,278,475, and Kane et al, U.S. Pat. 5,252,833, disclose field-emission flat-panel displays similar to that of Chason. In the field-emitter portions of the displays of Jaskie et al and Kane et al, openings extend through a gate electrode layer and an underlying dielectric layer to expose diamond particles formed on conductive/semiconductive paths situated on a substrate. The diamond particles provide electrons. An anode viewing-screen structure configured in basically the same way as that of Chason overlies the field emitter at a short distance above the gate electrode.

The flat-panel displays of Chason, Jaskie et al, and Kane et al generally operate in the following way. When the gate electrode is placed at a suitable voltage condition, electrons extracted from the electron-emissive particles at the bottom of one of the openings in the field emitter move generally toward the luminescent material of the anode viewing-screen structure. Upon being struck by impinging electrons, the luminescent material emits light which is visible at the exterior surface of the transparent plate. By appropriately controlling the voltage condition of the gate electrode, only electrons from electron-emissive particles in selected ones of the openings strike the luminescent material. A corresponding image is thereby produced on the viewing screen.

The gate electrode in a flat-panel CRT display can be used (a) to directly extract electrons from the electron-emissive elements or (b) to control the movement of electrons extracted by the anode. The gate electrode typically serves as an electron extractor in large-area light-weight flat-panel displays where internal supports are placed between the cathode and anode structures to withstand external pressures exerted on the display and thereby achieve a substantially constant cathode-to-anode spacing across the viewing area. The presence of the internal supports commonly limits the applied anode-to-cathode electric field to values less than that needed to adequately extract electrons from the electron-emissive elements.

Only part of the electrons moving towards the anode strike pixels that the electrons are intended to hit. Some of the electrons strike other parts of the flat-panel structure. Display performance is thereby degraded. In flat-panel CRT displays where the gate electrode functions as the electron extractor, this problem is of particular concern because the voltage on the gate electrode often causes the electrons to diverge from trajectories that end at desired parts of the luminescent material in the anode structure.

Specifically, some of the emitted electrons strike the gate layer and generate a leakage current. Other electrons strike the dielectric layer below the gate layer and cause charge to build up on the dielectric, thereby distorting the local electric field to which the electrons are subjected. It would be desirable to have a field-emission structure in which more of the electrons strike desired anode areas.

GENERAL DISCLOSURE OF THE INVENTION

The present invention furnishes a simple, reliable gated electron-emitting structure that generates an electron beam having improved collimation, especially in applications where the gate electrode functions as an electron-extracting element. The improved collimation is accomplished with the assistance of a special field-shaping layer that typically imparts a converging component to the local electric field which determines the trajectories of emitted electrons. The present gated field emitter is fabricated according to a simple, easily controllable manufacturing process.

In the gated field electron of the invention, an intermediate electrically non-insulating layer is situated over a lower electrically non-insulating region. As discussed further below, "electrically non-insulating" means electrically conductive or electrically resistive here. For example, both the lower non-insulating region and the intermediate non-insulating layer preferably consist principally of metal.

A dielectric layer overlies the intermediate non-insulating layer. An electrically non-insulating gate layer overlies the dielectric layer. An opening extends through the three layers—i.e, the gate layer, the dielectric layer, and the intermediate non-insulating layer—down to the lower non-insulating region. A multiplicity of laterally separated electron-emissive elements are situated over the lower non-insulating region within the opening below the bottom level of the gate layer.

The intermediate non-insulating layer is normally maintained at the same potential as the lower non-insulating region. When a voltage is applied between the gate layer and the lower non-insulating region for extracting electrons from the electron-emissive elements, the intermediate non-insulating layer affects the trajectories of the electrons. By suitable choice of the structural dimensions, improved collimation of the electron beam results. Preferably, the ratio of the thickness of the dielectric layer to the thickness of the intermediate non-insulating layer is in the range of 1:1 to 4:1, and the ratio of the mean diameter of the opening to the thickness of the intermediate non-insulating layer is in the range of 1:1 to 10:1.

More particularly, an anode is normally situated a short distance above the gate layer. When electrons are emitted from the electron-emissive elements and move towards the anode, the electric field to which the electrons are subjected functions as an electrostatic lens. The presence of the intermediate non-insulating layer causes the electrostatic lens to have a converging component. This, in turn, causes the trajectories of the electrons generally to converge towards the centerline (or optic axis) of the opening in which the electron-emissive elements are located.

Furthermore, the electric field just above the electron-emissive elements is stronger near the middle of the opening than at the edges of the opening. More electrons are thus emitted from electron-emissive elements near the center of the opening where the properties of the electrostatic lens are the most favorable. The net result is that a reduced percentage of emitted electrons strike the gate layer and underlying dielectric. The electron-emitter performance is improved.

In manufacturing a gated electron emitter that utilizes the intermediate non-insulating layer of the invention, any of several processing sequences can be employed to form the intermediate non-insulating, dielectric, and gate layers over the lower non-insulating region with the opening passing through the three layers. The electron-emissive elements can be created over the lower non-insulating region before or after the opening is formed through the three layers.

BRIEF DESCRIPTION OF THE DRAWINGS

FIGS. 5*a*, 5*b*, 5*b*1, 5*b*2, and 5*c* are cross-sectional front views representing steps in fabricating the field emitter of FIG. 1.

FIGS. 6*a*, 6*b*, 6*b*1, 6*b*2, and 6*c* are cross-sectional front views representing alternative steps in fabricating the field emitter of FIG. 1.

Like reference symbols are employed in the drawings and in the description of the preferred embodiments to represent the same or very similar item or items.

DESCRIPTION OF THE PREFERRED EMBODIMENTS

Herein, the term "electrically insulating" (or "dielectric") generally applies to materials having a resistivity greater than $10^{10}$ ohm-cm. The term "electrically non-insulating" thus refers to materials having a resistivity below $10^{10}$ ohm-cm. Electrically non-insulating materials are divided into (a) electrically conductive materials for which the resistivity is less than 1 ohm-cm and (b) electrically resistive materials for which the resistivity is in the range of 1 ohm-cm to $10^{10}$ ohm-cm. These categories are determined at an electric field of no more than 1 volt/μm.

Examples of electrically conductive materials (or electrical conductors) are metals, metal-semiconductor compounds (such as metal silicides), and metal-semiconductor eutectics (such as gold-germanium). Electrically conductive materials also include semiconductors doped (n-type or p-type) to a moderate or high level. Electrically resistive materials include intrinsic and lightly doped (n-type or p-type) semiconductors. Further examples of electrically resistive materials are cermet (ceramic with embedded metal particles), other such metal-insulator composites, graphite, amorphous carbon, and modified (e.g., doped or laser-modified) diamond.

Figure 1:
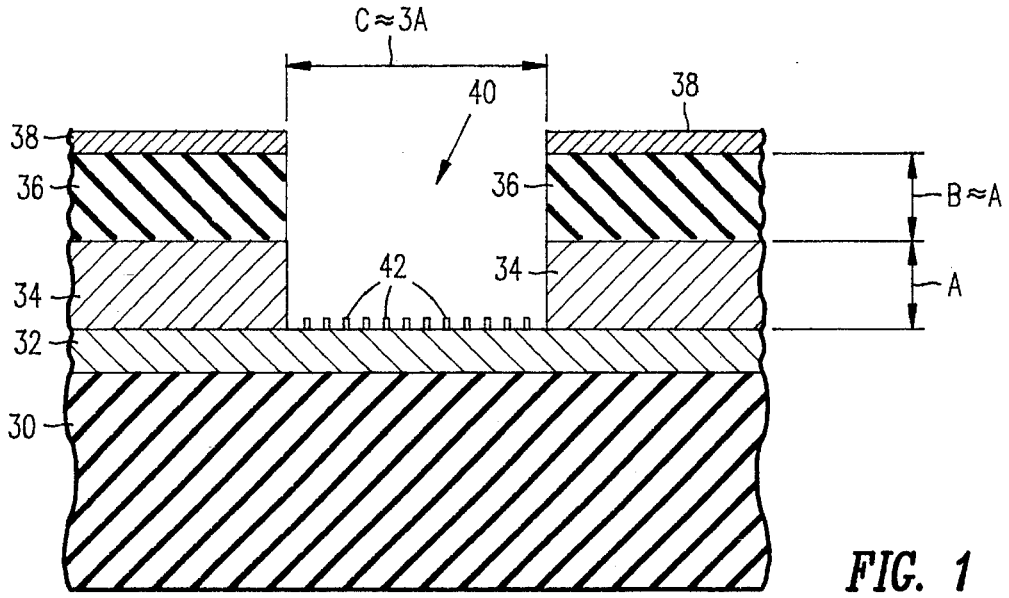
FIG. 1 is a cross-sectional front view of a field-emission structure according to the invention.

Referring to FIG. 1, it illustrates a gated field-emission structure configured according to the teachings of the invention. This field emitter is typically employed to excite phosphors on a faceplate (not shown in FIG. 1) in a CRT of a light-weight large-area flat-panel display such as a flat-panel television or a flat-panel video monitor for a personal computer, a lap-top computer, or a work station.

The field emitter in FIG. 1 contains an electrically insulating substrate 30 consisting of ceramic or glass. Substrate 30 is typically a plate having a largely flat upper surface and a largely flat lower surface extending substantially parallel to the upper surface. In a flat-panel CRT display, substrate 30 constitutes at least part of the backplate (or baseplate).

Substrate 30 furnishes support for the field-emission structure. As such, the substrate thickness is at least 500 μm. In a 25-cm (diagonal) flat-panel display where internal supports are placed between the phosphor-coated faceplate and the field emitter, the substrate thickness is 1–2 mm. If substrate 30 provides substantially the sole support for the field emitter, the substrate thickness is 4–14 mm.

A lower electrically non-insulating region 32, which is typically configured as a layer of approximately constant thickness, lies along the top of substrate 30. Lower non-insulating region 32 typically consists of a metal such as chromium. In this case, the thickness of region 32 is 0.5–1.5 μm. Other metals that can be used to form region 32 are nickel, titanium, tungsten, and molybdenum. Region 32 can also consist of silicon.

A field-shaping intermediate electrically non-insulating layer 34 lies along the top of lower non-insulating region 32 and makes electrical contact with region 32. Intermediate non-insulating layer 34 consists of any of the materials used to form region 32. Typically, non-insulating components 32 and 34 are formed with the same material. In some cases, layer 34 consists of a material that is selectively etchable with respect to the material that forms region 32.

A dielectric layer 36 is situated on top of intermediate non-insulating layer 34. Dielectric layer 36 typically consists of silicon oxide, a silicon-oxide-based dielectric, or/and silicon nitride. The ratio of the thickness B of dielectric layer 36 to the thickness A of intermediate non-insulating layer 34 is in the range of 1:1 to 4:1. Ideally, B/A equals 1:1.

An electrically non-insulating gate layer 38 lies on top of dielectric layer 36. Gate layer 38 consists of any of the materials used to form lower non-insulating region 32. The preferred thickness of layer 38 is 30–100 nm, typically 50 nm. However, the gate thickness could be greater than 100 nm. Also, the edge of layer 38 along opening 20 could be beveled.

An opening 40 extends through layers 38, 36, and 34 down to non-insulating region 32. Opening 40 is typically in the shape of a circle as viewed in the direction perpendicular to the top of gate layer 38. Opening 40 has a mean diameter C of 0.5–5 μm, typically 3 μm. The ratio of the mean diameter C of opening 40 to the thickness A of non-insulating layer 34 is in the range of 1:1 to 10:1. Ideally, C/A equals 3:1.

A group of laterally separated electron-emissive elements 42 are situated on the upper surface of non-insulating region 32 within opening 40. The upper ends of electron-emissive elements 42 lie below the bottom level of gate layer 38. Each of elements 42 emits electrons when gate layer 38 is raised to a suitable voltage relative to region 32. Because non-insulating layer 34 is in contact with region 32, layer 34 is normally at the same voltage as region 32.

An anode (not shown in FIG. 1) is situated at a selected distance, typically 0.25–5 mm, above the field emitter. The anode collects the electrons emitted from elements 42 under the extracting influence of gate electrode 38. The electron-emission current density at the anode is typically at least 0.1 $mA/cm^2$.

In a flat-panel CRT display, the anode is typically a thin reflective metal film that covers phosphors on the inside of the faceplate. When the electrons reach the anode, they strike the phosphors. This causes the phosphors-to emit light visible at the exterior surface of the faceplate.

Internal supports (also not shown) extend between the field emitter and the anode structure to hold off the external (normally atmospheric) pressure exerted on the flat-panel display in order to maintain a fixed anode-to-cathode spacing. The internal supports, commonly referred to as spacers, typically are thin walls. Internal supports of a type suitable for the field emitter of FIG. 1 are described in Fahlen et al, U.S. patent application Ser. No. 8/012,542, filed 1 Feb. 1993, now allowed, and Spindt et al, U.S. patent application Ser. No. 8/188,857, filed 29 Jan. 1994, now abandoned in favor of continuation U.S. patent application Ser. No. 8/505,841, filed 20 Jul. 1995. The contents of Ser. Nos. 8/012,542 and 8/188,857 are incorporated by reference herein.

The anode is maintained at a high positive voltage, typically in the vicinity of 5,000–10,000 volts, relative to lower non-insulating region 32 and gate layer 38. However, the anode voltage could be considerably lower, for example, in the vicinity of 500–1,500 volts. In either case, due to the presence of the internal supports, the applied anode-to-gate electric field is typically limited to approximately 2 volts/μm. This value is less than that needed to extract sufficient electrons from elements 42 to achieve the above-mentioned minimum current density of 0.1 $mA/cm^2$ at the anode.

Figure 2:
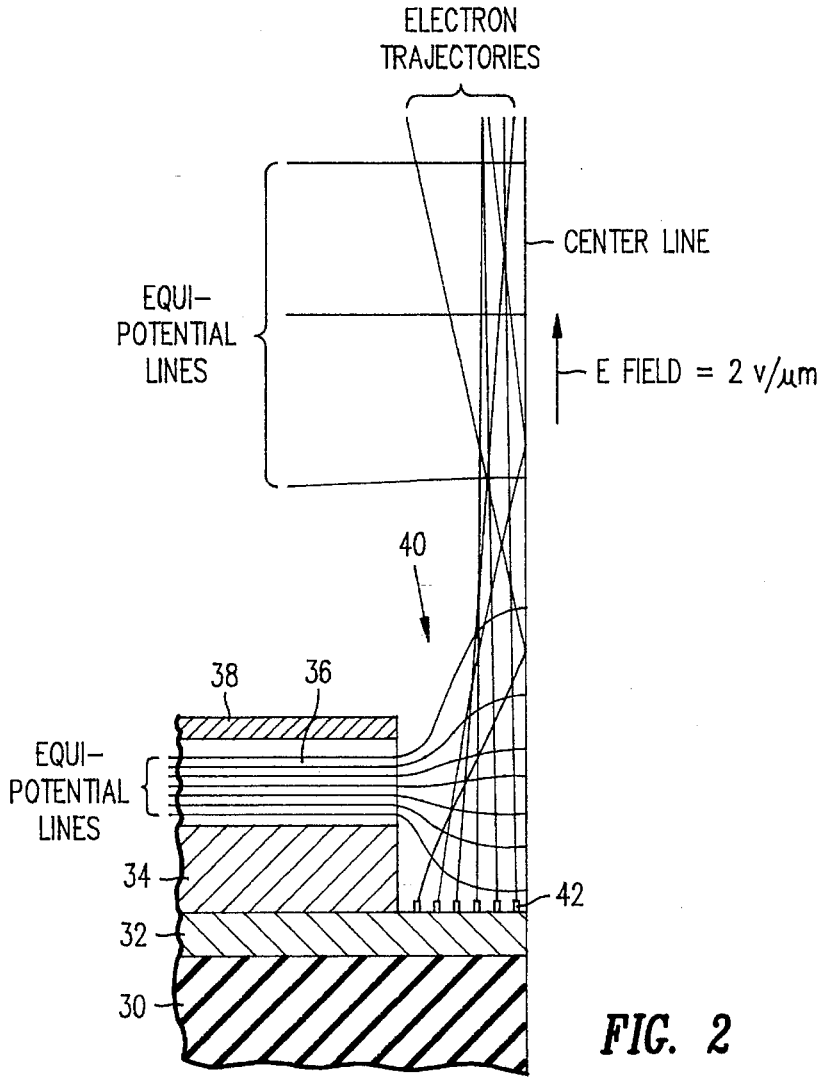
FIG. 2 is a cross-sectional front view of electron trajectories and equipotential lines for the inventive field emitter of FIG. 1.

FIG. 2 illustrates a computer simulation for the performance of the field emitter of FIG. 1 in an application where the applied anode-to-gate electric field is 2 volts/μm. Most of the left half of the structure of FIG. 1 is shown in FIG. 2. The lines extending upward from electron-emissive elements 42 in FIG. 2 represent the trajectories of electrons emitted from elements 42 in a direction normal to the upper surface of non-insulating region 32. The emitted electrons move generally toward the anode (unshown but situated above the field emitter).

Electrons emitted from elements 42 are subjected to the electric field between lower non-insulating region 32 and the anode. The value of the electric field along the top of region 32 at the middle of opening 40 is approximately 14 volts/μm in the simulation of FIG. 2. The electric field functions as an electrostatic lens with respect to the emitted electrons.

As indicated in FIG. 2, the trajectories of the emitted electrons converge on the vertical centerline (optic axis) of opening 40. The electrostatic lensing effect of the electric field thus has a converging component. Even though some of the electrons eventually diverge from the centerline of opening 40 before reaching the (unshown) anode/phosphors, none of the electrons in the simulation of FIG. 2 strike gate layer 38 or dielectric layer 36.

Electrons emitted from elements 42 near the edge of opening 40 diverge from the centerline of opening 40 at nearer points along the centerline than electrons provided from elements 42 near the middle of opening 40. For the typical case in which the anode is situated at some point beyond the top of FIG. 2, the action of the electrostatic lens thus causes the electrons originating near the middle of opening 40 to form the narrowest electron beam.

As illustrated by the lowest equipotential line in FIG. 2, the local electric field where the electron trajectories originate (i.e., at electron-emissive elements 42) is generally greater in the middle of opening 40 than at its edge. Since the emission current density increases with increasing electric field strength, the net effect is that more electrons are emitted from elements 42 situated at locations where the narrowest electron beam is produced.

Figure 3:
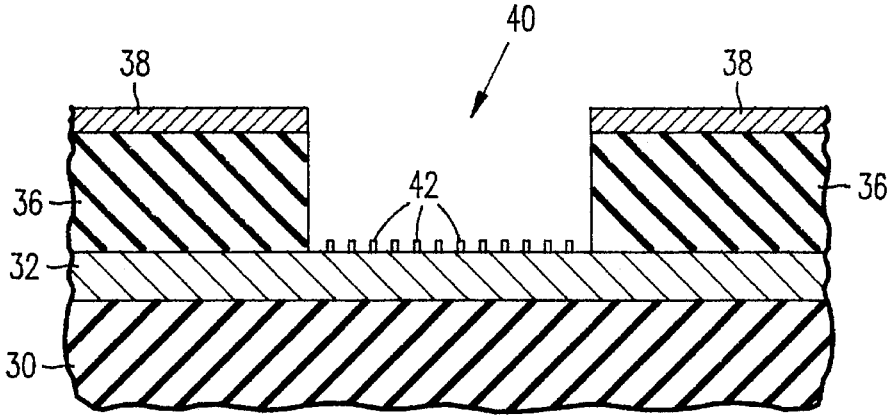
FIG. 3 is a cross-sectional front view of a field-emission structure that lacks the intermediate non-insulating layer of the field emitter in FIG. 1.

For purposes of comparison, FIG. 3 illustrates a field-emission structure configured the same as the field emitter of FIG. 1 except that intermediate non-insulating layer 34 is absent. Dielectric layer 36 thus lies directly on lower non-insulating region 32 in the field emitter of FIG. 3.

Figure 4:
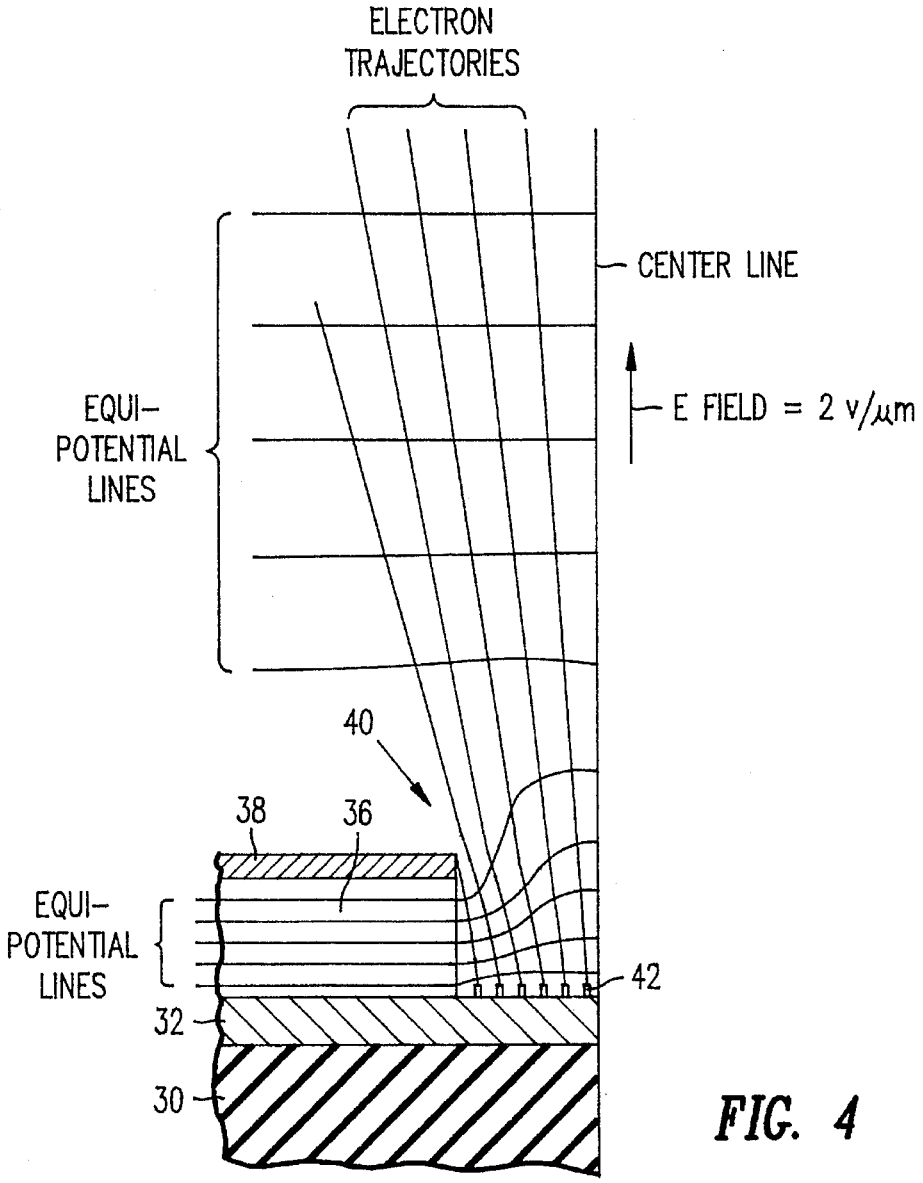
FIG. 4 is a cross-sectional front view of electron trajectories and equipotential lines for the field emitter of FIG. 3.

FIG. 4 depicts a computer simulation for the performance of the field emitter in FIG. 3 for the case where the applied anode-to-gate electric field again is 2 volts/μm. The dimensions and material characteristics for the computer simulation of FIG. 4 are the same as those in the computer simulation of FIG. 2 except for the absence of intermediate non-insulating layer 34 in FIG. 4.

As in FIG. 2, the lines extending upward from electron-emissive elements 42 in FIG. 4 represent the trajectories of electrons emitted from elements 42 in a direction normal to the upper surface of non-insulating region 32. The emitted electrons likewise move towards an upwardly situated (again unshown) anode. The value of the electric field along the top of lower non-insulating region 32 at the center of opening 40 in FIG. 4 is approximately 20 volts/μm.

All the emitted electrons diverge from the centerline of opening 40 in the simulation of FIG. 4. Unlike the simulation of FIG. 2 where intermediate non-insulating layer 34 is present, the electrostatic lensing effect of the electric field in the simulation of FIG. 4 lacks a converging component. The electrostatic lens in FIG. 4 only has a diverging component. In fact, the trajectory for the left-most electron in FIG. 4 intersects gate layer 38.

The trajectory divergence in FIG. 4 is greater for electrons emitted from elements 42 near the edge of opening 42 than near the middle. Also, as illustrated by the lowest equipotential line in FIG. 4, the local electric field in the vicinity of where the electron trajectories originate is greater at the edge of opening 40 than in the middle. Electrons emitted from elements 40 situated at locations where the divergence is greatest emit more electrons in the simulation of FIG. 4. This is precisely opposite to the simulation of FIG. 2.

In short, comparison of FIGS. 2 and 4 shows that the presence of intermediate non-insulating layer 34 causes the lensing effect of the electric field to have a converging component. The presence of layer 34 also causes more electrons to be emitted from elements 42 situated at locations where the divergence is the lowest. Fewer electrons strike gate electrode 38 or dielectric layer 36 in the device of FIG. 1 than in that of FIG. 3. Furthermore, the narrower electron beam in the field emitter of FIG. 1 reduces the number of electrons that strike phosphor areas other than the desired one in a flat-panel CRT display.

The field-emission structure of FIG. 1 can be fabricated in various ways. Turning to FIGS. 5*a*–5*c* (collectively "FIG. 5"), they jointly illustrate two general processes for manufacturing the field emitter. In both processes, lower non-insulating region 32 is separately created over substrate 30 as shown in FIG. 5*a*.

In one of the processes represented in FIG. 5, intermediate non-insulating region 34 is deposited directly on lower non-insulating region 32 so as to make electrical contact with region 32. Dielectric layer 36 is deposited on region 34. Gate layer 38 is then deposited on layer 36 to produce the structure shown in FIG. 5*b*.

Using a suitable photoresist mask (not shown), opening 40 is etched through layers 34–38 to expose part of region 32. Alternatively, opening 40 can be created by etching along charged-particle tracks as described in Spindt et al, co-filed U.S. patent application Ser. No. 08/269,229, "Use of Charged-Particle Tracks in Fabricating Gated Electron-Emitting Devices", now allowed. During the etch, region 32 can act as an etch stop if the materials that form layer 34 and region 32 are selectively etchable with respect to each other. A timed etch can alternatively be used. Electron-emissive elements 42 are then formed on the exposed part of region 32. FIG. 5*c* illustrates the final structure.

In the other process represented in FIG. 5, dielectric layer 36 is deposited on intermediate non-insulating layer 34 after which gate electrode 38 is deposited on layer 36 to produce the structure depicted in FIG. 5*b*1. The structure formed with layers 34–38 is separate from the structure formed with components 30 and 32 at this stage. Using a suitable photoresist mask (not shown) or a charged-particle track etching technique, opening 40 is etched through the structure consisting of layers 34–38. See FIG. 5*b*2. This structure is then mounted on top of the structure consisting of components 30 and 32. Electron-emissive elements 42 are formed on the part of lower non-insulating region 32 exposed through opening 40. FIG. 5*c* again illustrates the final structure.

FIGS. 6*a*–6*c* (collectively "FIG. 6") illustrate two further general processes for manufacturing the field emitter of FIG. 1. In both of these processes, lower non-insulating region 32 is deposited on substrate 30. Electron-emissive elements 42 are then created on the entire upper surface of layer 32. FIG. 6*a* depicts the structure at this stage.

In one of the processes represented in FIG. 6, intermediate non-insulating layer 34 is deposited on lower non-insulating region 32 including over electron-emissive elements 42 in such a way that layer 34 electrically contacts portions of layer 32 not covered by elements 42. Dielectric layer 36 is deposited on layer 34 after which gate layer 38 is deposited on layer 36 to produce the structure illustrated in FIG. 6*b*. Using one of the etching techniques employed in the process of FIG. 5, opening 40 is etched through the layers 34–38 to expose part of layer 32. FIG. 6*c* shows the final structure in which part of elements 42 are exposed through opening 40, while the remainder of elements 42 are buried along the interface between layers 32 and 34.

In the other process represented in FIG. 6, dielectric layer 36 is deposited on non-insulating layer 34 after which gate layer 38 is deposited on layer 36 to produce the separate structure shown in FIG. 6*b*1. Again using one of the etching procedures described for the process of FIG. 5, opening 40 is etched through the structure consisting of layers 34–38. See FIG. 6*b*2. This structure is then mounted on top of the structure consisting of components 30, 32, and 42. FIG. 6*c* again depicts the final structure.

Opening 40, with electron-emissive elements 42 situated on the exposed portion of lower non-insulating region 32, is normally replicated many times across the field-emission structure. Region 32 is typically patterned into a group of parallel electrically non-insulating emitter lines laterally separated from one another. One or more of openings 40 extend through layers 34–38 down to each of these emitter lines. In such a case, layer 34 is divided into a like number of parallel electrically non-insulating lines shaped similarly to the emitter lines.

Electron-emissive elements 42 typically consist of carbon-containing electron-emissive particles as described in Twichell et al, "Structure and Fabrication of Electron-Emitting Devices Utilizing Electron-Emissive Particles Which Typically Contain Carbon," co-filed U.S. patent application Ser. No. 08/269,283. Electron-emissive particles 42 are distributed across non-insulating region 32 at the bottom of opening 40 in a random manner. For example, particles 42 can be dispersed randomly across region 32 and then heated to bond particles 42 to region 32. As a result, particles 42 are electrically coupled to region 32. Electrically non-insulating bonding material may be used in the bonding process.

Figure 7:
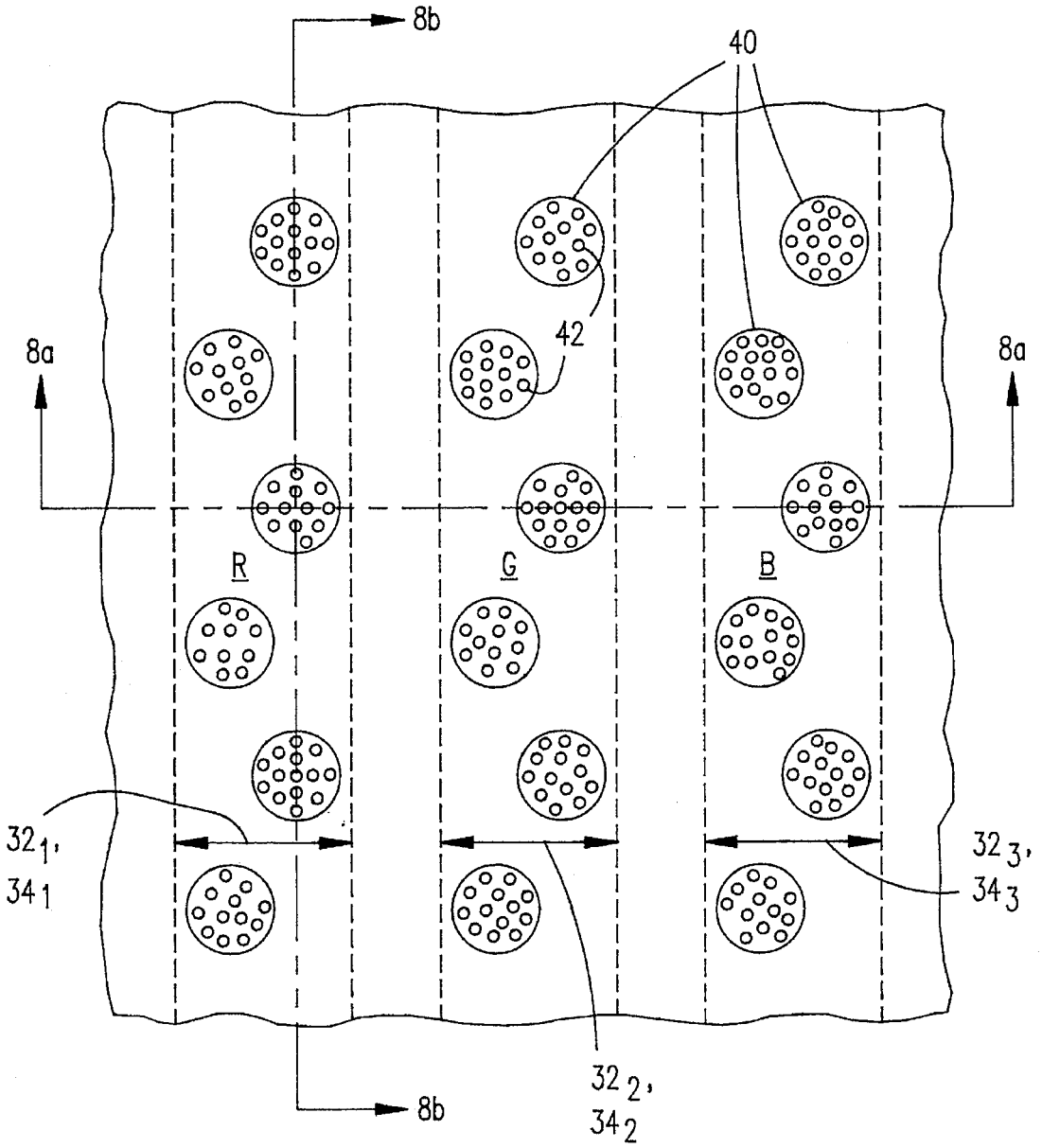
FIG. 7 is a plan view of a structure that employs a plurality of the field emitters in FIG. 1. The structure in FIG. 7 typically represents the field-emitter portion of a single pixel in a flat-panel CRT display.

FIG. 7 illustrates an exemplary layout of a section of a large-area field emitter configured in the preceding way. The dashed lines in FIG. 7 represent the lateral edges of three emitter lines $\mathbf{32}_1$, $\mathbf{32}_2$, and $\mathbf{32}_3$ into which non-insulating region 32 is divided. The dashed lines also represent the lateral edges of three corresponding non-insulating lines $\mathbf{34}_1$, $\mathbf{34}_2$, and $\mathbf{34}_3$ that form non-insulating layer 34.

In the illustrated example, six openings 40 extend through each intermediate line $\mathbf{34}_i$ down to corresponding emitter line $\mathbf{32}_i$, where i is an integer running from 1 to 3. Typically, the size of openings 40 compared to the width of each emitter line 32 is much less than that shown in FIG. 7. Likewise, the density of open spaces 40 is considerably greater than that illustrated in FIG. 7.

The viewing area along the faceplate of a color flat-panel display consists of an array of rows and columns of adjoining pixels. Each pixel is typically square. In a preferred embodiment, each pixel is subdivided into three equal-width phosphor stripes, one for each of red (R), green (G), and blue (B). Assuming for the purposes of explanation that the phosphor stripes are oriented vertically, the stripes extend from the lower edge of each pixel to its upper edge. Accordingly, each stripe extends from the bottom edge of the viewing area to the top edge of the viewing area.

The structural section shown in FIG. 7 could, for example, be the portion of a field emitter encompassed (or subtended) by one pixel in a color flat-panel display. Each emitter line $\mathbf{32}_i$ is situated across from, and runs parallel to, a corresponding one of the phosphor stripes in the pixel. Line pairs $\mathbf{32}_1/\mathbf{34}_1$, $\mathbf{32}_2/\mathbf{34}_2$, and $\mathbf{32}_3/\mathbf{34}_3$ are respectively used to control the red, green, and blue phosphors stripes where the emitted electrons are collected.

The side dimension of each square pixel, as represented by the portion of the large-area field emitter shown in FIG. 7, is approximately 0.3 mm in a preferred embodiment. In particular, each emitter line $\mathbf{32}_i$ or intermediate non-insulating line $\mathbf{34}_i$ typically has a width of 80 μm. The distance between each pair of emitter lines 32 is typically 25 μm.

Figure 8A:
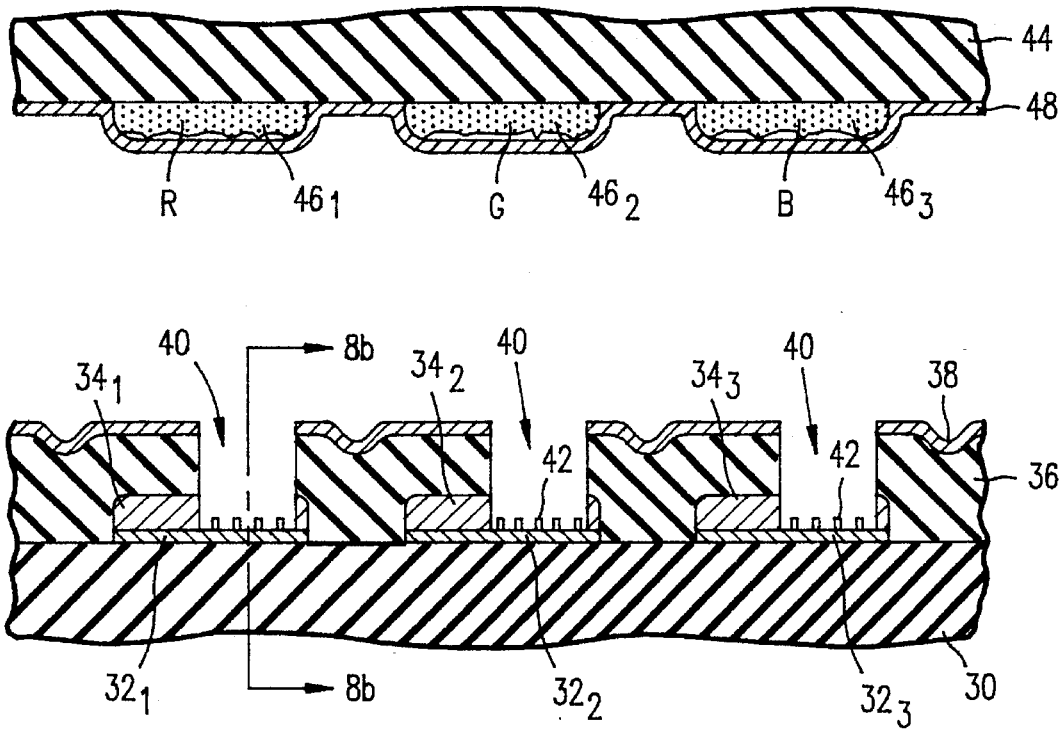
FIGS. 8*a* and 8*b* respectively are cross-sectional front and side views of the flat-panel pixel in FIG. 7. The cross section of FIG. 8*a* is taken through plane 8*a*—8*a* in FIGS. 7 and 8*b*. The cross section of FIG. 8*b* is taken through plane 8*b*—8*b* in FIGS. 7 and 8*a*.
Figure 8B:
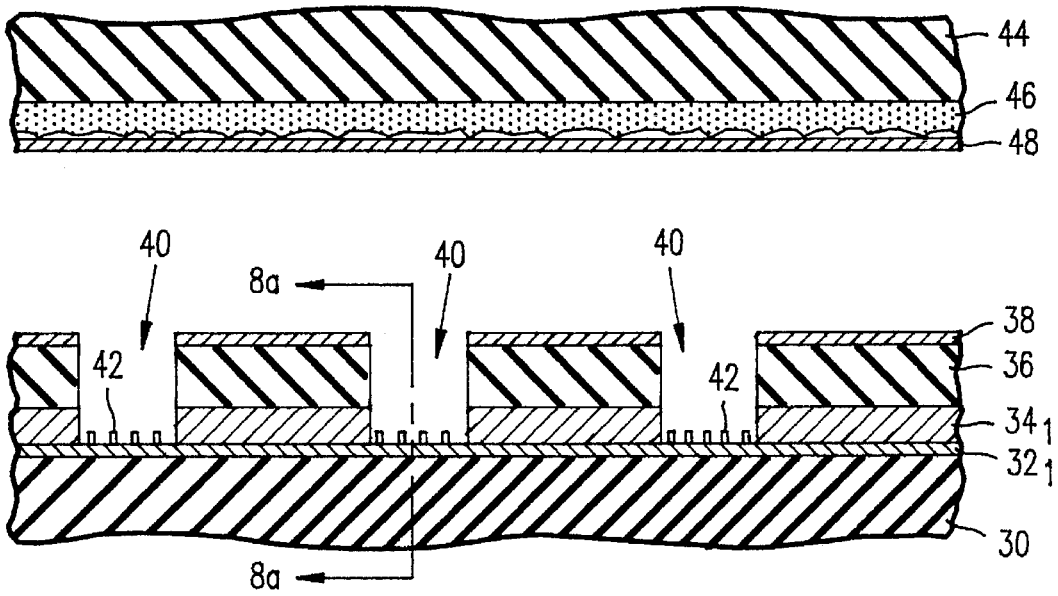

FIGS. 8*a* and 8*b* depict a complete pixel for a high-voltage flat-panel CRT display where the anode-to-cathode voltage is 5,000–10,000 volts. The bottom portions of FIGS. 8*a* and 8*b* are front and side views of the field-emitter portion of the pixel typically represented by FIG. 7. The top parts of FIGS. 8*a* and 8*b* represent a faceplate structure situated above the field-emitter portion of the pixel. The faceplate structure consists of a flat electrically insulating faceplate 44, three phosphor stripes $\mathbf{46}_1$, $\mathbf{46}_2$, and $\mathbf{46}_3$ (collectively "46"), and a thin light-reflective metal layer 48, typically aluminum, that constitutes the anode.

Each phosphor stripe $\mathbf{46}_i$ is situated vertically above, and is of approximately the same width as, corresponding emitter line $\mathbf{32}_i$. As a result, the spacing between phosphor stripes 46, including stripes 46 in the pixel(s) to the left and/or right of the illustrated pixel, is approximately the same as the spacing between emitter lines 32. In the preferred case described above, the phosphor-stripe width is approximately 80 μm, while the inter-stripe spacing is approximately 25 μm.

Directional terms such as "lower" and "down" have been employed in describing the present invention to establish a frame of reference by which the reader can more easily understand how the various parts of the invention fit together. In actual practice, the components of a field emitter may be situated at orientations different from that implied by the directional terms used here. The same applies to the way in which the fabrication steps are performed in the invention. Inasmuch as directional terms are used for convenience to facilitate the description, the invention encompasses implementations in which the orientations differ from those strictly covered by the directional terms employed here.

While the invention has been described with reference to particular embodiments, this description is solely for the purpose of illustration and is not to be construed as limiting the scope of the invention claimed below. For example, substrate 30 could be deleted if lower non-insulating region 32 is a continuous layer of sufficient thickness to support the structure. Insulating substrate 30 could be replaced with a composite substrate in which a thin electrically insulating layer overlies a relatively thick electrically non-insulating layer that furnishes the necessary structural support.

Region 32 and layer 34 could be patterned in configurations other than parallel lines. Region 32 could even be unpatterned.

The present field emitter could be used in low-voltage CRT flat-panel displays where the anode-to-cathode voltage is typically in the vicinity of 500–1,500 volts. In this case, the anode is typically a transparent electrical conductor, such as indium-tin oxide, situated between the faceplate and the phosphors.

Gate layer 38 could be used to modulate the movement of electrons extracted from electron-emissive elements 42 by the anode. Various modifications and applications may thus be made by those skilled in the art without departing from the true scope and spirit of the invention as defined in the appended claims.

We claim:

1. An electron-emitting structure comprising:

a lower electrically non-insulating region;

an intermediate electrically non-insulating layer situated over the lower non-insulating region and electrically coupled to it;

a dielectric layer situated over the intermediate non-insulating layer, the ratio of the thickness of the dielectric layer to the thickness of the intermediate non-insulating layer being in the range of 1:1 to 4:1;

an electrically non-insulating gate layer situated over the dielectric layer, an opening extending through the three layers down to the lower non-insulating region, the ratio of the mean diameter of the opening to the thickness of the intermediate non-insulating layer being in the range of 1:1 to 10:1; and a multiplicity of laterally separated electron-emissive elements situated over the lower non-insulating region within the opening below the bottom level of the gate layer.

2. A structure as in claim 1 wherein the electron-emissive elements are distributed across substantially the entire surface portion of the lower non-insulating region exposed through the opening.

3. A structure as in claim 1 wherein the lower non-insulating region and the intermediate non-insulating layer consist principally of metal.

4. A structure as in claim 1 wherein the lower non-insulating region and the intermediate non-insulating layer consist principally of the same material.

5. A structure as in claim 1 further including a substrate comprising electrically insulating material situated under the lower non-insulating region.

6. A structure as in claim 1 wherein:

additional openings extend through the three layers down to the lower non-insulating region;

an additional multiplicity of electron-emissive elements are situated over the lower non-insulating region within each additional opening below the bottom level of the gate layer;

the lower non-insulating region is a patterned layer comprising a group of generally parallel lines; and at least one of the multiplicities of electron-emissive elements is situated over each line.

7. A structure as in claim 1 further including an anode situated above, and spaced apart from, the gate layer, electrons which are emitted from the electron-emissive elements and move toward the anode being subjected to an electric field that provides an electrostatic lensing effect, the intermediate non-insulating layer causing the lensing effect to have a converging component.

8. A structure as in claim 7 wherein the electric field directly above where the electron-emissive elements emit electrons within the opening is generally stronger near the middle of the opening than at its edge as viewed in a direction generally perpendicular to the surface portion of the lower non-insulating region exposed through the opening.

9. A structure as in claim 1 wherein the gate layer is placable at a voltage condition sufficient to extract electrons from the electron-emissive elements.

10. A structure as in claim 1 wherein the lower non-insulating region and the intermediate non-insulating layer consist principally of materials of different chemical composition.

11. A structure as in claim 1 wherein the electron-emissive elements comprise carbon-containing electron-emissive particles.

12. A method of fabricating a light-emitting structure, the method comprising the steps of:

providing an intermediate electrically non-insulating layer over a lower electrically non-insulating region such that the intermediate non-insulating layer is electrically coupled to the lower non-insulating region;

forming (a) a dielectric layer over the intermediate non-insulating layer such that the ratio of the thickness of the dielectric layer to the thickness of the intermediate non-insulating layer is in the range of 1:1 to 4:1, (b) an electrically non-insulating gate layer over the dielectric layer, and (c) an opening through the three layers such that the ratio of the mean diameter of the opening to the thickness of the intermediate non-insulating layer is in the range of 1:1 to 10:1; and subsequently furnishing a multiplicity of laterally separated electron-emissive elements over the lower non-insulating region within the opening below the bottom level of the gate layer such that the electron-emissive elements are electrically coupled to the lower non-insulating region.

13. A method as in claim 12 wherein the providing step is performed before the forming step.

14. A method as in claim 12 wherein the providing step is performed after the forming step.

15. A method as in claim 12 further including the step of creating the lower non-insulating region over electrically insulating material of a supporting substrate.

16. A method of fabricating a light-emitting structure, the method comprising the steps of:

furnishing multiple laterally separated electron-emissive elements over a lower electrically non-insulating region such that the electron-emissive elements are electrically coupled to the lower non-insulating region;

forming (a) a dielectric layer over an intermediate electrically non-insulating layer such that the ratio of the thickness of the dielectric layer to the thickness of the intermediate non-insulating layer is in the range of 1:1 to 4:1, (b) an electrically non-insulating gate layer over the dielectric layer, and (c) an opening through the three layers such that the ratio of the mean diameter of the opening to the thickness of the intermediate non-insulating layer is in the range of 1:1 to 10:1; and placing the intermediate non-insulating layer over the lower non-insulating region including over the underlying electron-emissive elements such that the intermediate non-insulating layer is electrically coupled to the lower non-insulating region and such that a multiplicity of the electron-emissive elements are present within the opening.

17. A method as in claim 16 wherein the placing step is performed after the furnishing step and before the forming step such that the multiplicity of electron-emissive elements are exposed through the opening during its formation.

18. A method as in claim 16 wherein the placing step is performed after the furnishing and forming steps.

19. A method as in claim 16 further including the step of creating the lower non-insulating region over electrically insulating material of a supporting substrate.

20. An electron-emitting structure comprising:

a lower electrically non-insulating region;

an intermediate electrically non-insulating layer situated over the lower non-insulating region and electrically coupled to it, the lower non-insulating region and the intermediate non-insulating layer consisting principally of materials of different chemical composition;

a dielectric layer situated over the intermediate non-insulating layer;

an electrically non-insulating gate layer situated over the dielectric layer, an opening extending through the three layers down to the lower non-insulating region; and a multiplicity of laterally separated electron-emissive elements situated over the lower non-insulating region within the opening below the bottom level of the gate layer.

21. A structure as in claim 20 wherein the electron-emissive elements are distributed across substantially the entire surface portion of the lower non-insulating region exposed through the opening.

22. A structure as in claim 20 wherein:

additional openings extend through the three layers down to the lower non-insulating region;

an additional multiplicity of electron-emissive elements are situated over the lower non-insulating region within each additional opening below the bottom level of the gate layer;

the lower non-insulating region is a patterned layer comprising a group of generally parallel lines; and at least one of the multiplicities of electron-emissive elements is situated over each line.

23. A structure as in claim 20 further including an anode situated above, and spaced apart from, the gate layer, electrons which are emitted from the electron-emissive elements and move toward the anode being subjected to an electric field that provides an electrostatic lensing effect, the intermediate non-insulating layer causing the lensing effect to have a converging component.

24. A structure as in claim 20 wherein the electron-emissive elements comprise carbon-containing electron-emissive particles.

25. A method comprising the steps of:

providing an intermediate electrically non-insulating layer over a lower electrically non-insulating region such that the intermediate non-insulating layer is electrically coupled to the lower non-insulating region and such that the lower non-insulating region and the intermediate non-insulating layer consist principally of materials of different chemical composition;

forming (a) a dielectric layer over the intermediate non-insulating layer, (b) an electrically non-insulating gate layer over the dielectric layer, and (c) an opening through the three layers; and subsequently furnishing a multiplicity of laterally separated electron-emissive elements over the lower non-insulating region within the opening below the bottom level of the gate layer such that the electron-emissive elements are electrically coupled to the lower non-insulating region.

26. A method comprising the steps of:

furnishing multiple laterally separated electron-emissive elements over a lower electrically non-insulating region such that the electron-emissive elements are electrically coupled to the lower non-insulating region;

forming (a) a dielectric layer over an intermediate electrically non-insulating layer, (b) an electrically non-insulating gate layer over the dielectric layer, and (c) an opening through the three layers; and placing the intermediate non-insulating layer over the lower non-insulating region including over the underlying electron-emissive elements such that the intermediate non-insulating layer is electrically coupled to the lower non-insulating region, such that the lower non-insulating region and the intermediate non-insulating layer consist principally of materials of different chemical composition, and such that a multiplicity of the electron-emissive elements are present within the opening.

* * * * *